US005645130A

United States Patent [19]

Schoeps

[11] Patent Number: 5,645,130

[45] Date of Patent: Jul. 8, 1997

[54] HYDRAULIC TORQUE IMPULSE MECHANISM

[75] Inventor: Knut Christian Schoeps, Tyresö, Sweden

[73] Assignee: Atlas Copco Tools AB, Nacka, Sweden

[21] Appl. No.: 579,581

[22] Filed: Dec. 26, 1995

[30] Foreign Application Priority Data

Dec. 30, 1994 [SE] Sweden ..... 9500001

[51] Int. Cl.[6] ..... B25D 15/00

[52] U.S. Cl. ..... 173/93.5; 173/93; 464/25

[58] Field of Search ..... 173/93, 93.5, 93.6; 464/24, 25

[56] References Cited

U.S. PATENT DOCUMENTS

| | | | |
|---|---|---|---|
| 3,304,746 | 2/1967 | Kramer et al. . | |
| 3,672,185 | 6/1972 | Schoeps | 173/93 |
| 4,683,961 | 8/1987 | Schoeps . | |
| 4,767,379 | 8/1988 | Schoeps | 173/93.5 |
| 4,785,693 | 11/1988 | Minamiyama et al. | 173/93.5 |
| 4,836,296 | 6/1989 | Biek | 173/93.5 |
| 4,967,852 | 11/1990 | Tatsuno | 173/93 |
| 5,092,410 | 3/1992 | Wallace et al. . | |

FOREIGN PATENT DOCUMENTS 0185639 6/1986 European Pat. Off. .

*Primary Examiner*—Scott A. Smith

*Attorney, Agent, or Firm*—Frishauf, Holtz, Goodman, Langer & Chick

[57] ABSTRACT

A hydraulic torque impulse mechanism intended for a torque delivering tool and including a rotatively driven drive member (10) provided with a concentric fluid chamber (12) and radially acting cam elements (25, 26, 28), an output shaft (16) extending through the drive member (10) fluid chamber (12) and having two radial cylinder bores (18, 19) which communicate continuously with a central high pressure chamber (23) and support two piston elements (20, 21) which are reciprocable in the cylinder bores (18, 19) by the cam elements (25, 26, 28), whereby the output shaft (16) comprises two moderating chambers (45, 46) which communicate continuously with the high pressure chamber (23) and comprise a pressure responsive yielding system in the form of membranes (50) which are supported by end closures (47) of the moderating chambers (45, 46) and which are elastically deformable by the pressure difference between the high pressure chamber (23) and the fluid chamber (12) as this pressure difference is below a certain level only.

5 Claims, 2 Drawing Sheets

HYDRAULIC TORQUE IMPULSE MECHANISM

BACKGROUND OF THE INVENTION

This invention relates to a hydraulic torque impulse mechanism which is intended for a torque delivering tool and which includes a rotatively driven drive member provided with a concentric fluid chamber as well as a radially acting cam means, an output shaft extending into the drive member fluid chamber and having two radially extending cylinder bores, which communicate continuously with each other via a central high pressure chamber, and two oppositely disposed piston elements reciprocable in the cylinder bores by the cam means.

Impulse mechanisms of the above type, disclosed for example in U.S. Pat. No. 5,092,410, are characterized by a very efficient impulse generation, because the high pressure chamber is very small and the fluid entrapped therein at impulse generation is compressed simultaneously from two opposite directions. This makes the pressurized fluid volume very stiff, and because of this high stiffness, the pressure build-up and the retardation of the drive member takes place very abruptly at each impulse generation.

Accordingly, the resulting torque impulses have an extremely steep characteristic. This is a drawback when providing the tool with a torque transducer for producing electric signals reflecting the torque magnitude of the delivered impulses. The very steep impulse characteristics makes it difficult to obtain reliable signals from the torque transducer.

SUMMARY OF THE INVENTION

The main object of the invention is to provide an impulse mechanism of the above type comprising a moderating volume with a pressure responsive yielding system for increasing the elasticity of the entrapped pressurized fluid volume, thereby making the pressure build-up in the high pressure chamber less steep. This yielding system is active as the pressure difference between the high pressure chamber and the drive member fluid chamber is below a certain level only.

Further characteristics and advantages of the invention will appear from the following specification.

A preferred embodiment of the invention is described below in detail with reference to the accompanying drawings.

DESCRIPTION OF THE PREFERRED EMBODIMENT

Figure 1:
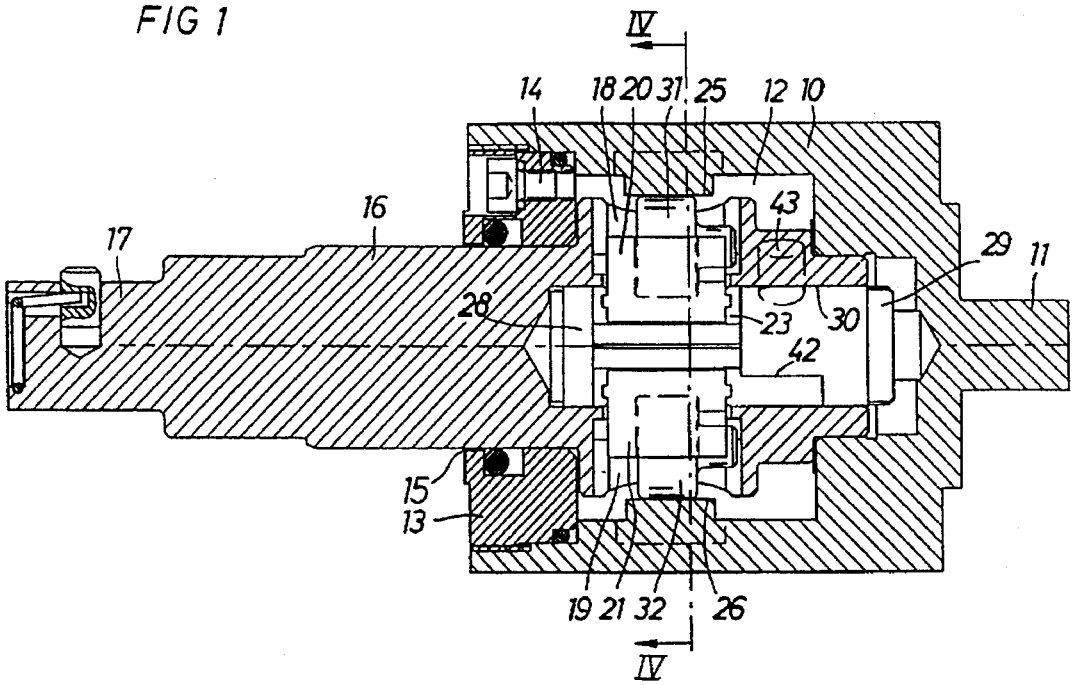
FIG. 1 shows a longitudinal section through an impulse mechanism according to the invention.

The impulse mechanism shown in the drawing figures is particularly intended for a screw joint tightening tool and comprises a drive member 10 rotatively driven by a motor (not shown) via a rear stub axle 11.

The drive member 10 is formed with a concentric fluid chamber 12 which at its forward end is closed by a threaded annular end wall 13. The latter is provided with an fluid filler plug 14.

The end wall 13 is also formed with a central opening 15 which forms a plain bearing for an output shaft 16. The latter extends by its rear end into the fluid chamber 12 and is formed with a square portion 17 at its forward end for connection to a standard type nut socket. At its inner end, the output shaft 16 is provided with two radially directed cylinder bores 18, 19 which extend coaxially relative to each other. Within these cylinder bores 18, 19 there are movably guided piston elements 20, 21 defining between them a central high pressure chamber 23.

The drive member 10 is provided with a cam mechanism for accomplishing controlled radial reciprocating movements of the piston elements 20, 21 at relative rotation between the drive member 10 and the output shaft 16. The cam mechanism comprises a cam surface 24 with two 180 degrees spaced cam lobes 25, 26 on the cylindrical wall of the fluid chamber 12, and a central cam spindle 28. The latter is connected to the drive member 10 by means of a claw type clutch 29 and extends into a coaxial bore 30 in the output shaft 16. At relative rotation between the drive member 10 and the output shaft 16, the cam lobes 25, 26 on the fluid chamber wall act to urge simultaneously both piston elements 20, 21 inwardly, toward each other. With a 90° phase lag in relation to the cam lobes 25, 26, the cam spindle 28 acts on the piston elements 20, 21 to move the latters outwardly into positions where they again can be activated by the cam lobes 25, 26.

Figure 2:
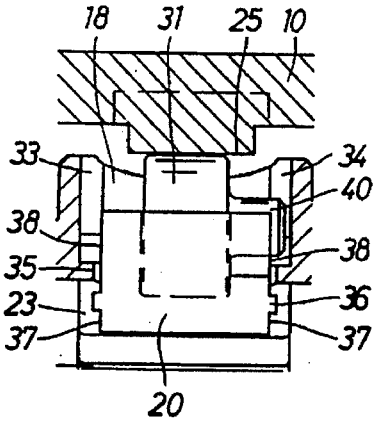
FIG. 2 shows, on a larger scale, a fragmentary view of the impulse mechanism in FIG. 1.
Figure 3:
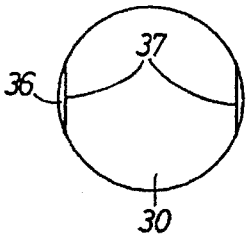
FIG. 3 shows an end view of a piston element.

As apparent from FIGS. 1, 2 and 3, each of the piston elements 20, 21 comprises a cylindrical cup-shaped body and a roller 31 and 32, respectively. The purpose of the rollers 31, 32 is to reduce the frictional resistance between the piston element and the cam lobes 25, 26.

The cylinder bores 18, 19 are formed with longitudinal grooves 33, 34 which extend from the outer ends of the bores 18, 19 but do not reach the inner ends of the bores 18, 19. A circular cylindrical seal portion 35 is left for sealing cooperation with a circular seal portion 36 on the piston elements 20, 21. The seal portion 36 is located between outer flat portions 37 and inner flat portions 38 whereby is formed by-pass passages past the seal portion 35 as the seal portion 36 on the piston element 20, 21 is out of register with the seal portion 35. See FIG. 2.

In order to lock the piston elements 20, 21 against rotation and to ensure that the flat portions 37, 38 are always aligned with the grooves 33, 34, each roller 32 is formed with an axial extension 40 which is partly received and guided in one of the grooves 34.

For avoiding two torque impulses to be generated during each relative revolution between the drive member 10 and the output shaft 16, the cam spindle 28 is formed with a flat portion 42 which is arranged to open up a communication between the high pressure chamber 23 and the fluid chamber 12 by cooperating once every relative revolution with a radial opening 43 in the output shaft 16. See FIG. 1.

Moreover, the output shaft 16 is provided with two each other opposite impulse moderating chambers 45, 46. These chambers 45, 46 are formed by a diametrically extending bore which intersects the cylinder bores 18, 19 as well as the axially extending bore 30. Each one of the chambers 45, 46 has an end cap 47 which is secured to the output shaft 16 by a thread connection 48. The end cap 47 serves as a mounting and support device for a circular steel membrane 50 and is formed with a shallow part-spherical abutment surface 51. A retaining ring 52 is located inside the end cap 47 to clamp the outer rim of the membrane 50 into sealing contact with the surface 51. A central through opening 54 provides a fluid communication between the fluid chamber 12 and the end cap 47 facing side of the membrane 50.

The membrane 50, which forms a wall section defining the respective chamber, has a nominal flat circular shape and is elastically deformable by the pressure difference between the high pressure chamber 23 and the surrounding fluid chamber 12. As the pressure difference exceeds a certain level, the membrane 50 is urged into contact with the abutment surface 51, whereby the yielding action of the membrane 50 is limited.

In operation, the drive member 10 receives a driving torque from a motor via the stub axle 11, and the output shaft 16 is connected to a screw joint to be tightened by means of a nut socket attached to the square portion 17.

Figure 4A:
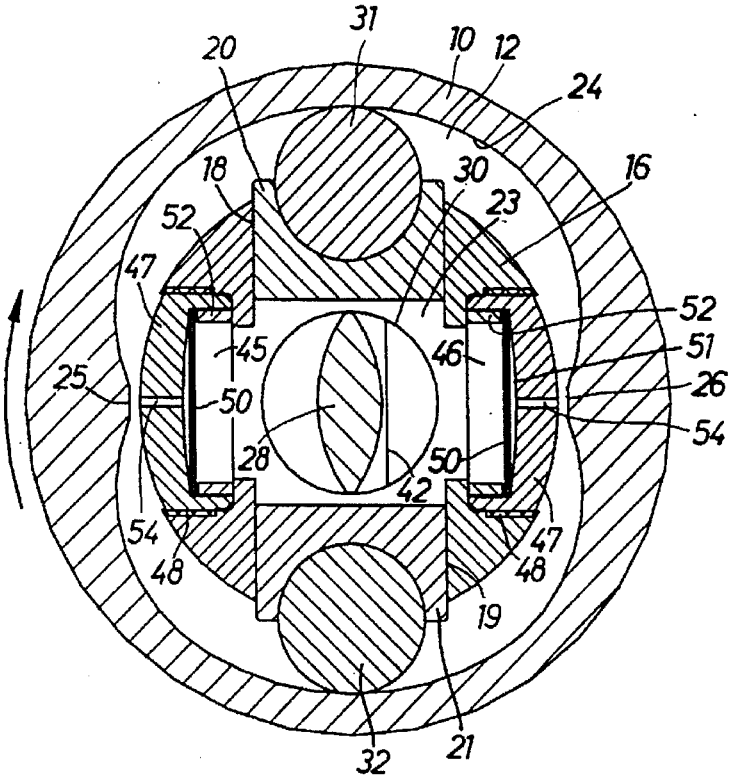
FIG. 4*a* and 4*b* show cross sections along line IV—IV in FIG. 1, illustrating two different relative positions of the elements of the impulse mechanism.
Figure 4B:
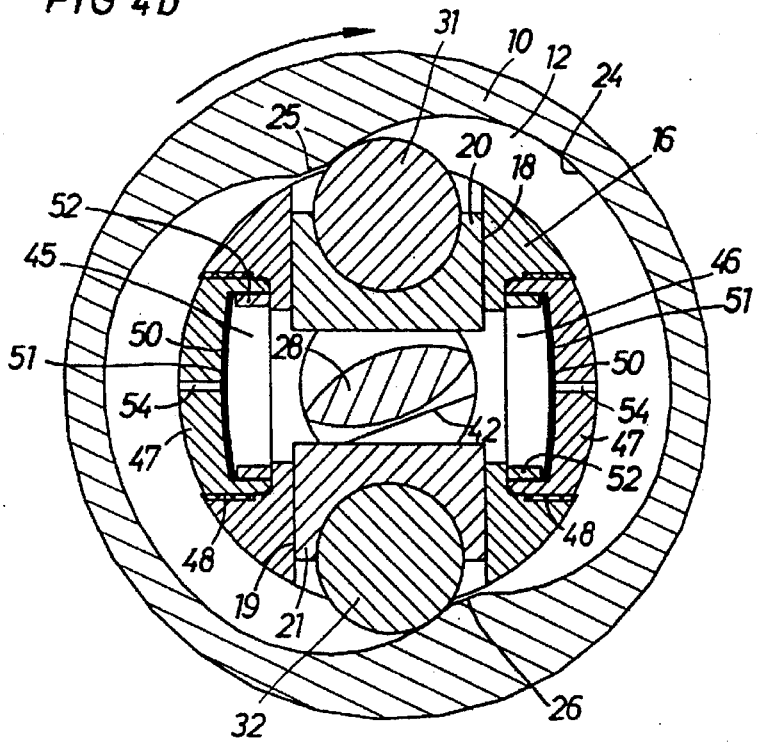

During the low torque running down phase of the tightening process, the cam lobes 25, 26 are moved from the positions illustrated in FIG. 4*a* to positions in which they start engaging the rollers 31, 32. The seal portions 36 of the pistons 20, 21 start cooperating with the seal portions 35 in the cylinder bores 18, 19. To begin with, the transferred torque is low enough not to generate any real pressure increase in the high pressure chamber 23. Accordingly, the pressure difference between the high pressure chamber 23 and the fluid chamber 12 is not yet high enough to cause any deformation of the membranes 50.

As the screw joint is run down and the pretensioning phase starts, the cam lobes 25, 26 start urging the pistons 20, 21 inwardly, thereby compressing the fluid volume entrapped in the high pressure chamber 23 and the moderating chambers 45, 46. Resulting from the increased pressure in the high pressure chamber 23 and the moderating chambers 45, 46 the membranes 50 yield outwardly, thereby providing an increased elasticity of the entrapped fluid volume. As the pressure in the high pressure chamber 23 reaches a certain level, however. the membranes 50 abut against the surfaces 51, whereby further deformation of the membranes 50 is stopped. The fluid behind the membranes 50 is expelled into the fluid chamber 12 through the openings 54.

As the pistons 20, 21 are moved further inwardly by the cam lobes 25, 26, the seal portions 36 lose their sealing cooperation with the seal portions 35 in the cylinder bores 18, 19, which means that fluid from the high pressure chamber 23 may escape past these seal portions 35, 36 and that the pressure in the high pressure chamber 23 drops rapidly. Consequently, the torque transfer from the drive member 10 to the output shaft 16 is interrupted.

Figure 5:
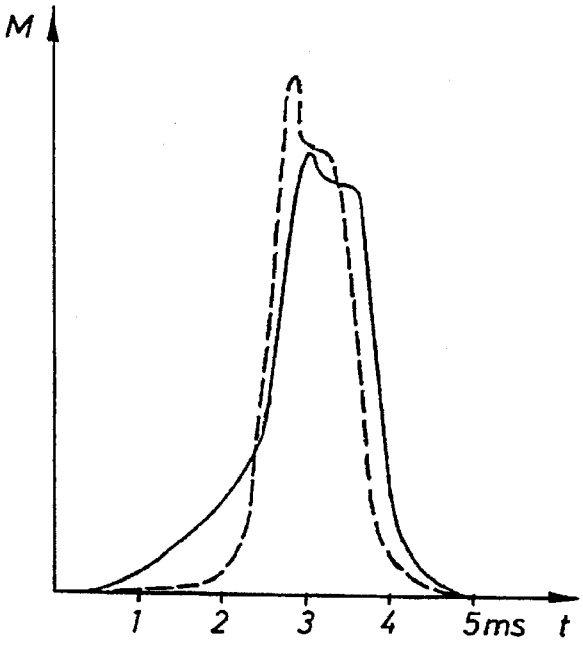
FIG. 5 shows a diagram illustrating the torque impulse characteristic with and without the employment of the invention.

In FIG. 5, there is illustrated the transferred torque M in relation to time t during a typical torque impulse.

The dash-line curve illustrates the torque impulse characteristics obtained in a prior art impulse mechanism of the type described in the preamble of claim 1. Characteristic features of this prior art impulse is a very abrupt and steep torque growth during the first part of the impulse and a sharp peak torque before the screw joint starts rotating. Both of these characteristics make it very difficult to obtain reliable signals from a torque transducer fitted to the output shaft. The process is simply too fast and abrupt to be correctly registered by any electronic process control and/or monitoring equipment.

In comparison, the solid line curve illustrates the impulse characteristics of a mechanism employing the features of the invention. As appear from the diagram, the torque growth during the first 2.5 ms (milliseconds) takes place rather slowly due to the yielding action of the membranes 50. At the end of this initial stage, the membranes 50 have reached their fully deformed positions and abut against the surfaces 51 in the end caps 47. This means that the resiliency of the fluid volume entrapped in the high pressure chamber 23 suddenly decreases and that the pressure in the high pressure chamber 23 as well as the transferred torque increase more rapidly.

However, due to the increased volume of the high pressure chamber provided by the additional moderating chambers 45, 46, the torque increase is not at all so steep as for a prior art impulse mechanism. Note the difference in inclination between the solid line curve and the dash-line curve in FIG. 5. In the example illustrated in FIG. 5, the peak torque is reached in about twice the time of the same impulse phase of a prior art mechanism.

The increased high pressure chamber volume also reduces the peak torque level but extends the impulse duration, which means the same amount of energy is transferred.

The slower torque growth and the less sharp peak torque of the impulses generated by a torque impulse mechanism according to the invention makes it possible to practically use a torque transducer and a process control and/or monitoring equipment.

I claim:

1. Hydraulic torque impulse mechanism intended for a torque delivering tool, comprising a rotatively driven drive member (10) provided with a concentric fluid chamber (12) as well as a radially acting cam mechanism (25, 26, 28), an output shaft (16) extending through said drive member fluid chamber (12) and having two radially extending cylinder bores (18, 19) which communicate continuously with a central high pressure chamber (23), and two oppositely disposed piston elements (20, 21) which are reciprocable in said cylinder bores (18, 19) by said cam mechanism (25, 26, 28), wherein:

said output shaft (16) comprises at least one impulse moderating chamber (45, 46) which communicates continuously with said high pressure chamber (23) to add volume to said high pressure chamber (23), and said at least one impulse moderating chamber (45, 46) comprises a pressure responsive and elastically yielding wall section (50) by which the elasticity of the pressurized fluid volume in said high pressure chamber (23) is increased as the pressure difference between said high pressure chamber (23) and said drive member fluid chamber (12) is only below a certain level.

2. Impulse mechanism according to claim 1, wherein said yielding wall section (50) comprises one or more membranes (50) forming part of said at least one impulse moderating chamber (45, 46), each one of said membrane or membranes (50) being supported by a mounting member (47) which comprises an abutment (51) for limiting the elastic deformation of said membrane (50).

3. Impulse mechanism according to claim 2, wherein:

said at least one moderating chamber (45, 46) comprises two diametrically opposed compartments (45, 46) formed by a transverse bore extending through said output shaft (16) perpendicularly to said cylinder bore (18, 19) and intersecting said high pressure chamber (23), and said mounting member (47) comprises two end caps (47) confining said compartments (45, 46) formed by said transverse bore.

4. Impulse mechanism according to claim 3, wherein said end caps (47) confine said membrane or membranes ( 50 ).

5. Impulse mechanism according to claim 4, wherein:

each of said membranes (50) has a flat nominal shape, and each of said end caps (47) comprises a part-spherical surface forming said abutment (51).

* * * * *